US007752714B2

(12) United States Patent
Dudley

(10) Patent No.: US 7,752,714 B2
(45) Date of Patent: Jul. 13, 2010

(54) GRIP APPARATUS AND METHOD

(76) Inventor: Charles Jeffrey Dudley, 4633 Sunset Pt., Destin, FL (US) 32541

( * ) Notice: Subject to any disclaimer, the term of this patent is extended or adjusted under 35 U.S.C. 154(b) by 457 days.

(21) Appl. No.: 11/895,661

(22) Filed: Aug. 27, 2007

(65) Prior Publication Data

US 2008/0295284 A1 Dec. 4, 2008

Related U.S. Application Data

(60) Provisional application No. 60/881,810, filed on Jan. 22, 2007.

(51) Int. Cl.
*B25G 1/10* (2006.01)

(52) U.S. Cl. ..... 16/430; 16/421

(58) Field of Classification Search ..... 16/430, 16/431, 436, 422, DIG. 12; 401/6, 7, 8; 473/300, 473/301, 551, 552, 568; 24/3.13, 10 R, 115 N, 24/3.12, 12, 16 PB See application file for complete search history.

(56) References Cited

U.S. PATENT DOCUMENTS

| | | | | | |
|---|---|---|---|---|---|
| 2,200,626 | A * | 5/1940 | Lamkin | 473/203 |
| 2,721,741 | A * | 10/1955 | Prendergast | 473/301 |
| 2,780,464 | A * | 2/1957 | Ashley | 473/206 |
| 2,896,889 | A * | 7/1959 | Hershberger et al. | 248/71 |
| 4,022,470 | A * | 5/1977 | Vidal | 473/301 |
| 5,722,575 | A * | 3/1998 | Smith | 224/217 |
| 5,785,607 | A * | 7/1998 | Huang | 473/301 |
| 5,816,933 | A * | 10/1998 | Huang | 473/301 |
| 2003/0139223 | A1 * | 7/2003 | Ulrich et al. | 473/301 |
| 2007/0127973 | A1 * | 6/2007 | Comstock et al. | 401/6 |

* cited by examiner

*Primary Examiner*—Chuck Y. Mah
(74) *Attorney, Agent, or Firm*—J. Nevin Shaffer, Jr

(57) ABSTRACT

A grip apparatus and method for use with hand held instruments and includes a hollow tubular section. An extension with a first end and a second end is connected with the hollow tubular section al the first end but not at the second end.

3 Claims, 2 Drawing Sheets

GRIP APPARATUS AND METHOD

CROSS REFERENCE TO RELATED APPLICATION

This application claims the benefit of previously filed U.S. provisional patent application No. 60/881,810 filed Jan. 22, 2007 for a "Grip Apparatus and Method". The Applicant hereby claims the benefit of this provisional application under 35 U.S.C. §119. The entire contents of this provisional application are incorporated herein by this reference.

FIELD OF THE INVENTION

This invention relates to a grip apparatus and method. In particular, in accordance with one embodiment, the invention relates to a grip apparatus and method for use with hand held instruments and includes a hollow tubular section. An extension with a first end and a second end is connected with the hollow tubular section at the first end but not at the second end.

BACKGROUND OF THE INVENTION

Generally speaking, the ability to grip things is what has separated man from the animals. The opposable thumb is useful for sure but still man has found that grip enhancements, things that make holding on to other things easier, to be very useful as well. This is easily seen, by way of example only and not by limitation, when the item to be gripped is a hand tool of some sort. Again, by way of example only and not by limitation, pencils and pens are common instruments that must be held/gripped continuously during use for them to function as intended. The constant pressure on a person's fingers caused by use of pencils and pens can create callouses and soreness. The prior art solution to this problem has been to add padding to the instrument so as to soften its surface and reduce the pain of using a pencil or pen.

One type of cushion that has been created is a hollow tubular section of flexible plastic or rubber like material. This hollow tubular section is fitted over the end of a pencil or pen and the plastic body of the tubular section provides a cushion effect for the user.

A problem with the hollow tubular sections known in the art is that they are not expandable. That is, they come in a certain length and may not be extended in any way beyond that length. Thus, they can only cover a certain area of the pencil or pen and the user has little or no flexibility in adapting the coverage to suit the user's own particular needs. Thus, there is a need in the art for a grip apparatus and method for use with instruments that enables a user to customize the area covered by the grip to suit the user's needs. It, therefore, is an object of this invention to provide a grip for instruments that is adaptable to a user's unique needs and capable of covering the instrument in many various manners.

SUMMARY OF THE INVENTION

Accordingly, a grip apparatus and method for use with hand held instruments includes, according to one embodiment, a hollow section. An extension with a first end and a second end is connected with the hollow section at the first end but not at the second end. Preferably, the grip is made from a stretchable, resilient plastic or rubber like material such that the hollow section expands as the instrument is inserted into it. The result of the expansion is that the hollow section exerts compressive force to the instrument, such as a pencil for example only, and is held in place by that force as well as by friction.

Likewise, the extension is preferably made from the same type of stretchable, resilient plastic or rubber like material. The extension, it is important to note, is attached at only one end and the other end is not attached to the hollow section. Thus, the extension is free to be wrapped around the instrument in any manner the user finds useful. Further, a much larger section of the instrument is capable of being covered with the extension. Likewise, the extension may be continuously wrapped around one part of the instrument, or the hollow section, to make a much larger/fatter/thicker covering in a particular area if desired.

According to one embodiment, the extension is flat and stretches along its length. When stretched and wrapped around the instrument, the material resists the stretching and attempts to return to its original length thus causing the extension to apply compressive force to the instrument too. Further, the material from which the extension is made is preferably slightly tacky or sticky and tends to stick to the instrument and itself thereby resisting the tendency to unwrap itself from the instrument.

According to another aspect of the invention, the extension includes perforations which, the Applicant has found, also aides in preventing the extension from unwrapping. In another aspect, a hole is provided in the second end of the extension such that the hole may be placed over one end of the instrument so as to secure the second end of the extension directly to the instrument by a method other than compression and/or sticky adhesion.

In another aspect, the hollow section is attached to one end of an instrument, as for example the writing end of a pencil, and the second end of the extension is attached to the other end of the pencil, the eraser end, thereby creating a carrying and/or attachment strap out of the length of the extension itself.

According to another embodiment of the invention, a grip apparatus includes a hollow tubular section wherein said hollow tubular section is stretchable and resilient and an extension with a first end and a second end where the first end is connected with the hollow tubular section at an angle and the second end is not connected to the hollow tubular section and where the extension is stretchable and resilient.

According to another aspect of the invention, the hollow tubular section includes exterior ribs. In a further aspect, the hollow tubular section is shorter in length than the extension. In another aspect, the grip apparatus is made of a tacky plastic.

According to another embodiment of the invention, a grip method includes providing a hollow section with an extension with a first end and a second end where the first end is connected with the hollow section and the second end is not connected to the hollow section and connecting the hollow section to an instrument.

According to a further aspect of the method, the extension is wrapped around the instrument. In another aspect, the extension includes a hole in the second end and the second end is connected with the instrument by placing the hole over the instrument. In a further aspect, the extension is connected with another object prior to the hole being placed over the instrument. In another aspect, the extension is at least partially wrapped around the hollow section.

DESCRIPTION OF THE DRAWINGS

Other objects, features and advantages of the present invention will become more fully apparent from the following detailed description of the preferred embodiment and the accompanying drawings in which.

DETAILED DESCRIPTION OF THE INVENTION

Figure 1A:
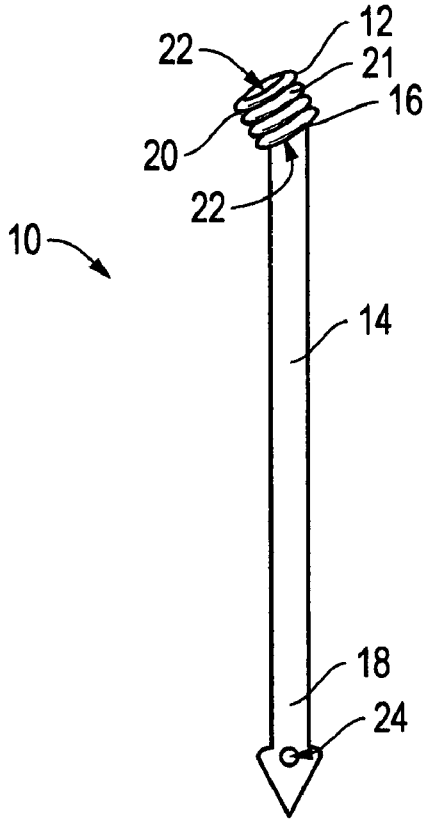
FIG. 1A is a side view of the grip apparatus of the present invention according to one embodiment.

The preferred embodiment of the present invention is illustrated by way of example in FIGS. 1-4. With specific reference to FIGS. 1A and 1B, grip apparatus 10 includes, according to a preferred embodiment, hollow section 12 and extension 14 where extension 14 includes a first end 16 and a second end 18 and first end 16 is attached to hollow section 12 and second end 18 is not attached to hollow section 12, as illustrated in FIG. 1A.

Hollow section 12 includes an exterior tubular grip 20 which creates the tubular form in conjunction with hollow space 22 which runs the length of exterior tubular grip 20 as illustrated. Preferably, exterior tubular grip 20 also includes ribs 21. Ribs 21 are expanded sections of the exterior tubular grip 22 which add to the cushion effect of exterior tubular grip 20. Obviously, ribs 21 may include a single rib 21 so as to provide the extended cushion and may be in any other useful form or shape other than a "rib"

Again, hollow section 12 is made from a stretchy plastic or rubber like material that is tacky or slightly sticky, as is known in the art. Whatever material it is made of whether now known or hereafter developed, the material must stretch and resist stretching at the same time. The material is, therefore, resilient and while capable of deformation, i.e. stretching, it must seek to maintain its original hollow shape. Obviously, the hollow section 12 may be formed in any desired forms, including tubular, oval, octagonal, square, and so forth for example only and not by limitation.

Still referring to FIG. 1A, extension 14 is attached to hollow section 12 at first end 16. Preferably, first end 16 is attached at an angle, as shown, so as to assist in the ease with which extension 14 may be wrapped around an instrument as discussed and disclosed more fully hereafter with regard to FIGS. 2-4. As shown, extension 14 is a flat, stretchable extension and, preferably, made from the same or similar material as hollow section 12. While stretchable in every direction, extension 14 is designed to stretch along its length most easily.

FIG. 1A also illustrates another aspect of the invention in which a hole 24 is formed in the second end 18. Hole 24 is big enough to allow it to be stretchingly placed over an instrument so as to directly attach second end 18 to an instrument as will be described more fully with regard to FIG. 4. FIG. 1A also illustrates another aspect of the invention where, preferably, hollow section 12 is shorter than extension 14. This is a unique feature of the invention in that hollow section 12 does not alone cover as much of an instrument as many prior art devices. However, because of extension 14, in combination with hollow section 12, an instrument may be covered in exactly the best places for each user. The major cushioning effect of hollow section 12 may be enough or it may be "reinforced" by wrapping extension 14 at least partially around hollow section 12 as well as on other places of the instrument.

Figure 1B:
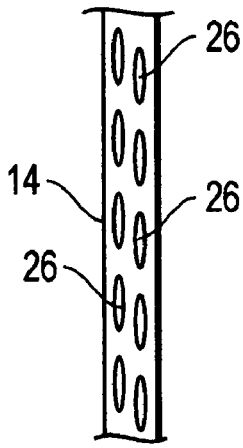
FIG. 1B is a close up view of the extension of the grip showing multiple perforations in the extension

Referring now to FIG. 1B, another aspect of the invention is illustrated in which extension 14 includes a number of cuts and/or perforations 26. Perforations 26, Applicant has found, assist in securing extension 14 in place when stretched and wrapped around an instrument.

Figure 2:
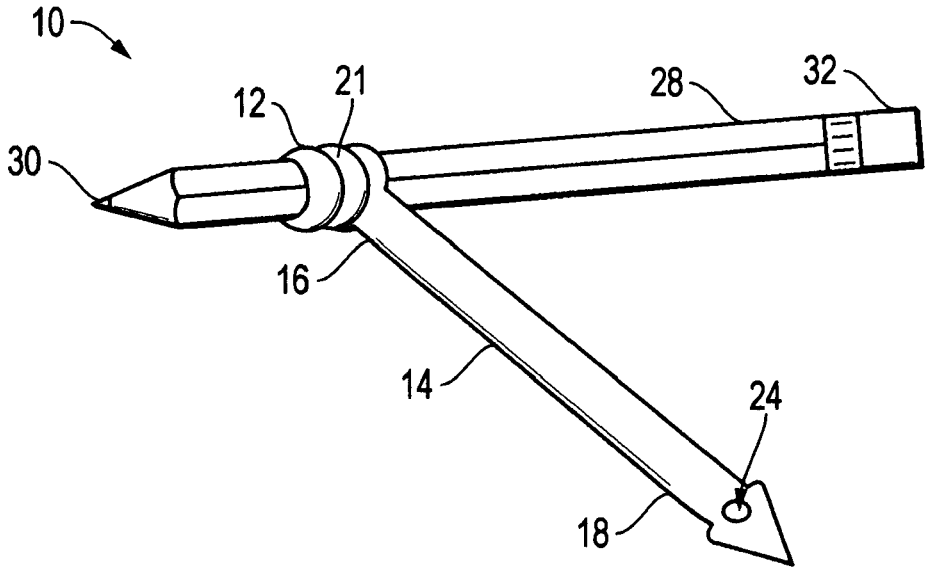
FIG. 2 is a side view of the grip showing the hollow tubular section attached to a pencil.

Referring now to FIG. 2, grip apparatus 10 is shown in the first step of attaching it to an instrument 28. Instrument 28 is shown in the form of a pencil with a writing end 30 and an eraser end 32, for example only and not by limitation. Obviously, instrument 28 may be a pen or a scalpel or any other hand held instrument now known or hereafter developed. The first step is to insert the writing end 30, for example only, into the hollow space 22 of hollow section 12 and locating the exterior tubular grip 20 on the instrument 28 in the desired location.

Figure 3:
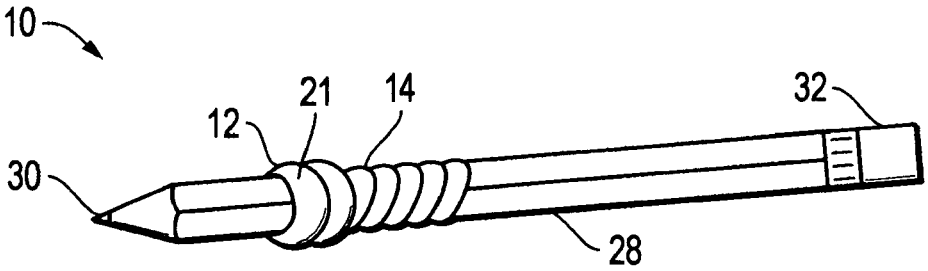
FIG. 3 is a side view of the grip as shown in FIG. 2 with the extension wrapped around the pencil.

FIG. 3 shows grip apparatus 10 fully attached to the instrument 28 by means of wrapping the free end, second end 18, of extension 14 around instrument 28. As discussed above, extension 18 may be wrapped in any place on instrument 28 the user desires, either close to hollow tubular section 12, as shown, so as to effectively extend hollow tubular section 12 or on top of hollow tubular section 12 to make it fatter and more "cushiony" or elsewhere along the length of instrument 28 as the user desires.

Figure 4:
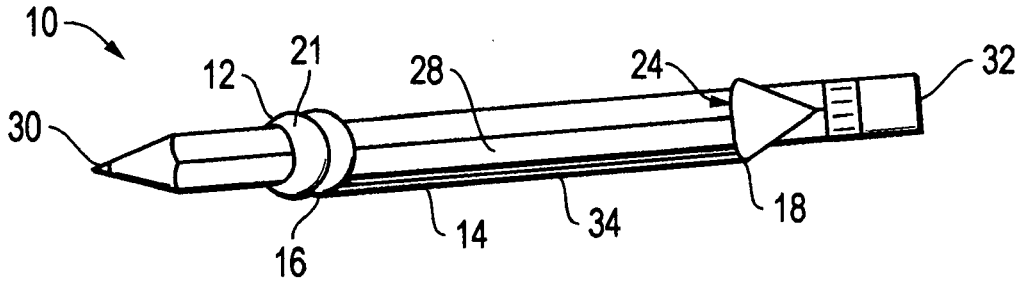
FIG. 4 is a side view of the grip as shown in FIG. 2 with the second end of the extension attached to the pencil thereby creating an attachment strap and/or handle from the extension.

FIG. 4 shows another aspect of the invention in which hole 24 in second end 18 of extension 14 has not been wrapped around instrument 28 but instead it has been stretched and placed around the eraser end 32, for example only, of instrument 28. In this aspect of the invention, extension 28 form a carrying strap 34 so that a user can carry the instrument 28 by means of the strap 34 or the strap 34 can be used to secure the instrument 28 to another object, such as for example only and not by limitation, a note book, back pack, etc. (not shown) so as to reduce the chances of losing the instrument 28.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as discussed and illustrated.

What is claimed is:

1. A grip method comprising:

a. providing a hollow section with an extension with a first end and a second end wherein said first end is connected with said hollow section and said second end is not connected to said hollow section; and b. connecting said hollow section to an instrument, wherein said extension includes a hole in said second end and said second end is connected with said instrument by placing said hole over said instrument and wherein said extension is connected with another object prior to said hole being placed over said instrument.

2. The method of claim 1 further comprising wrapping said extension around said instrument.

3. The method of claim 1 wherein said extension is at least partially wrapped around said hollow section.

* * * * *